United States Patent [19]

Lugo

[11] 4,288,078

[45] Sep. 8, 1981

[54] GAME APPARATUS

[76] Inventor: Julio I. Lugo, B. Boca - Buzon B106, Guayanilla, P.R. 00656

[21] Appl. No.: 96,207

[22] Filed: Nov. 20, 1979

[51] Int. Cl.[3] ..... A63F 3/00

[52] U.S. Cl. ..... 273/264

[58] Field of Search ..... 273/255, 261, 262, 264; D21/33-37

[56] References Cited

U.S. PATENT DOCUMENTS

| | | | |
|---|---|---|---|
| 499,041 | 6/1893 | Robbins | 273/264 |
| 957,800 | 5/1910 | Richardson | 273/264 |
| 1,184,572 | 5/1916 | Roberts | 273/262 |

FOREIGN PATENT DOCUMENTS

| | | | |
|---|---|---|---|
| 433081 | 9/1967 | Switzerland | 273/260 |
| 606406 | 3/1946 | United Kingdom | 273/264 |
| 1018741 | 2/1966 | United Kingdom | 273/264 |

OTHER PUBLICATIONS

*Nine Men's Morris, Games of the World,* ed. Grunfield, ©1975, Holt, Rinehart & Winston.

*Primary Examiner*—Richard C. Pinkham
*Assistant Examiner*—R. Carl Moy
*Attorney, Agent, or Firm*—Scrivener, Clarke, Scrivener and Johnson

[57] ABSTRACT

The disclosure is of a game apparatus in which two players manually move counters on a board having specific figures. The object of the game is to have five of a player's pieces placed colinearly along a diameter of the figure.

1 Claim, 4 Drawing Figures

GAME APPARATUS

SUMMARY OF THE INVENTION

The game comprises a game board having specific figures on it, counters to be moved on the game board, and means for determining the extent of each move. The game board figure comprises two concentric octagons and a six pointed star and a rectangle within the inner octagon, together with counters for each player and means for determining each move of the counters.

DESCRIPTION OF THE INVENTION

Figure 2:
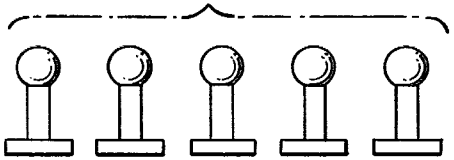
FIG. 2 shows a set of counters to be used by one of the players.

The game provided by the invention comprises a playing board which has printed, painted or otherwise marked on its upper or playing surface a diagram which provides the field on which the game is played, a number of counters for one of the players, a number of counters for a second player.

The playing board comprises a preferably rectangular piece 2 of preferably rigid material which may be of any size, shape or color, on the playing surface of which there is marked in any suitable manner a playing field which is constructed and arranged to have the following figures.

There is first provided an outer regular octagon A the sides of which intersect at points 2 to 16. Within this octagon there is provided a second octagon B which is concentric with octagon A and the sides of which are parallel, respectively, to the sides of the octagon A. The sides of the inner octagonal figure intersect at points 18 to 32 and as the two octagonal figures are concentric and their respective sides are parallel, the corner intersections 2 to 16 and 18 to 32 between the sides of each of the two figures are aligned radially, and radial lines through each pair meet in a common center X, these radial lines being denoted by numerals 34 to 48, inclusive.

Within the inner octagonal figure B there is provided a six-pointed star C the points of which are the corners 20, 22, 24, 28, 30, 32 of the inner octagonal figure B. This star-shaped figure is made up of two oppositely directed equilateral triangles, one of which has the sides 50, 52 and base 54 and the other of which has the sides 56, 58 and base 60. It will be seen that the apex of triangle 50, 52, 54 is at the corner point 22 of the inner octagonal figure B while the apices of the base 54 are at the corner points 28, 32 of the inner octagonal figure. The apex of the second triangle 56, 58, 60 is at the corner point 30 of the inner octagonal figure, while the ends of the base 60 of this second triangle are at the corner points 20, 24 of the inner octagonal figure.

Also within the inner octagonal figure B there is provided a square D having sides 54, 60, 62, 64, two of which are also the bases 54, 60 of the two oppositely directed triangular figures which constitute the star C.

These four figures, the outer octagon, the inner octagon, the six-pointed star and the square constitute the playing field of the game. All of the points of intersection of these figures lie in the two octagonal figures and are marked in some distinctive way such as by the large black circles shown in the drawings although any other distinctive and suitable designation may be used. The center point X is also marked in another and distinctive manner, as shown.

It will be seen that the line through points 2, 18, X, 26 and 10 divides the playing field into two mirror upper and lower parts. In one part the corners 4, 6, 8 of one half of the outer octagon are matched by points 16, 14, 12 of the other half of the octagon, while the points 20, 22, 24 of one half of the inner octagon are matched by points 32, 30, 28 of the other half. The points 4, 6, 8, 24, 20 of the one half and the points 12, 14, 16, 32, 28 of the other half constitute the starting points for the game, and the five counters held by each player are put on these points at the beginning of the game.

Figure 3:
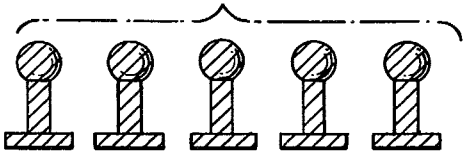
FIG. 3 shows a second set of counters to be used by another player.

As stated, each player has five counters, which may be suitably shaped and marked. In the disclosed form of the game the counters of each player are shaped as the pawn in the game of chess, and those of one player may be differently marked or colored from those of the other player, as shown in FIGS. 2 and 3.

When the game is begun each player puts his five counters on the points described above and each player then, in his turn, moves one of his pawns, it being understood that each counter may be moved only along a line beginning at the location of the counter and to another designated point, whether forward or backward along that line.

In continuing the game each player attempts to position four of his counters on points of one of the median lines, the points of these lines, excluding the center point X, being

2–18–26–10
4–20–28–12
6–22–30–14
8–24–32–16

When one of the players has four of his counters positioned on one of these combinations of points he then tries to move his fifth counter to the center point X. The first player to have all five counters on a line including one of these combinations and the center point X wins the game. It is to be understood that a counter cannot be moved to the center point X until the other four of the player's counters are placed on four aligned points as set forth above.

Figure 4:
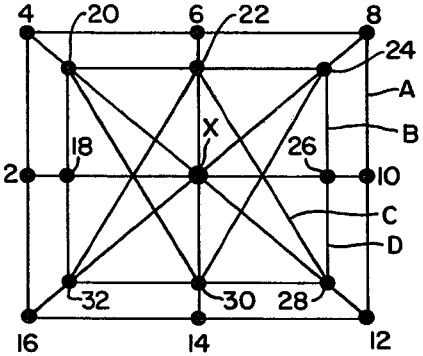
FIG. 4 shows an alternative configuration of the playing field of the game.
Figure 1:
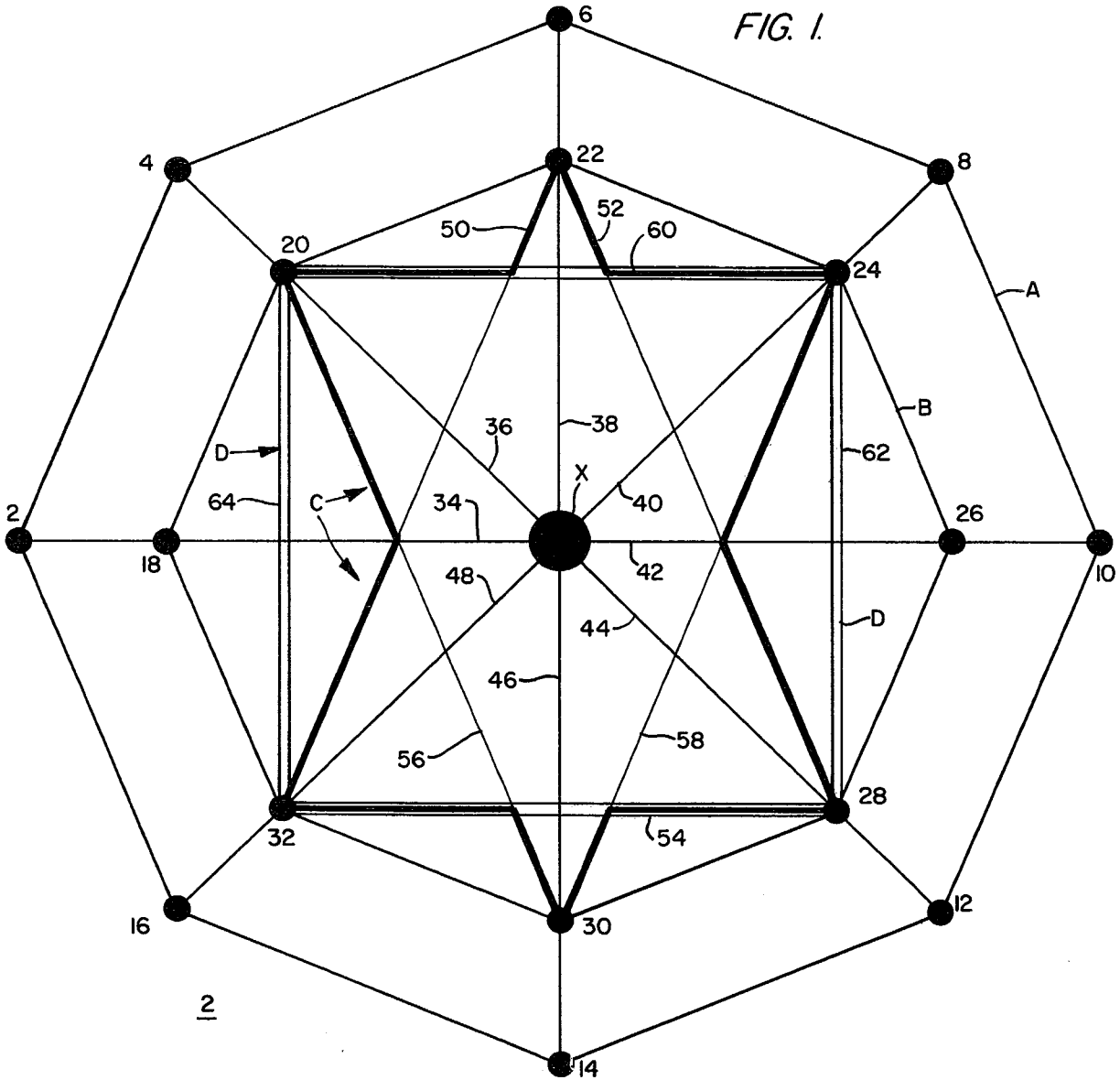
FIG. 1 is a view of the game board having thereon the figures of the game provided by the invention.

The playing field of the game may be formed in the octagonal shape illustrated in FIG. 1 or in the rectangular shape illustrated in FIG. 4 in which all points are designated by the same reference numerals of the corresponding points of FIG. 1.

I claim:

1. A game for two players having playing rules and a scoring system, and comprising a board having a field consisting of a. a first regular octagonal figure, b. a second regular octagonal figure concentric with and within the first octagonal figure, with its sides parallel respectively to the sides of the first octagonal figure, c. radial lines extending through each aligned pair of corners of the two octagonal figures, all of said lines meeting at the common center of the two figures, d. each corner point of the two octagonal figures and the center point of intersection of the radial lines being distinctively marked, e. a six-pointed star within the inner octagonal figure, such star being formed by two oppositely extending isosceles triangular figures the apices and the ends of the bases of which are at opposite corner points of the inner octagonal figure, f. a square within the inner octagonal figure, two sides of which are formed by the bases of the two triangles of the six-pointed star and the other two sides of which join the end points of said bases, g. a first set of five counters to be used by one player, and a second set of five counters visually differentiated from the first set to be used by another player, h. the ends of the base of each of the triangular figures, the two corner points of the first octagonal figure which are aligned with said ends, and the corner point of the first octagonal figure between said two corner points providing initial positions for each set of counters from which the counters are moved in either direction along the radial lines of the field.

* * * * *